United States Patent [19]

Mally

[11] Patent Number: 4,712,458

[45] Date of Patent: Dec. 15, 1987

[54] FOOD LOAF SLICING MACHINE WITH IMPROVED STACKING CHARACTERISTICS

[75] Inventor: Timothy G. Mally, Oregon, Wis.

[73] Assignee: Oscar Mayer Foods Corporation, Madison, Wis.

[21] Appl. No.: 940,697

[22] Filed: Dec. 11, 1986

[51] Int. Cl.[4] ..... B26D 7/06; B26D 5/20

[52] U.S. Cl. ..... 83/86; 83/354; 83/355; 83/595

[58] Field of Search ..... 83/86, 90, 91, 351, 83/355, 592, 594, 595, 169, 354; 51/268; 181/225, 277

[56] References Cited

U.S. PATENT DOCUMENTS

| | | | |
|---|---|---|---|
| 3,161,215 | 12/1964 | Werder et al. | 83/276 |
| 3,842,698 | 10/1974 | Fitch et al. | 83/91 |
| 3,848,491 | 11/1974 | Flesch | 83/86 |
| 4,428,263 | 1/1984 | Lindee et al. | 83/354 |
| 4,512,228 | 4/1985 | Tarcisio | 83/355 |

*Primary Examiner*—E. R. Kazenske
*Assistant Examiner*—Eugenia A. Jones
*Attorney, Agent, or Firm*—Joseph T. Harcarik; Thomas R. Savoie; Daniel J. Donovan

[57] ABSTRACT

A high volume food loaf slicing machine in which a rotating and orbiting knife slices the loaf as it advances through a slicing station. The turbulent air generated by the rotating and orbiting knife is reduced in the vacinity of the stacking slices by baffles and is redirected through a vent port and away from the stacking slices.

11 Claims, 5 Drawing Figures

FIG.5
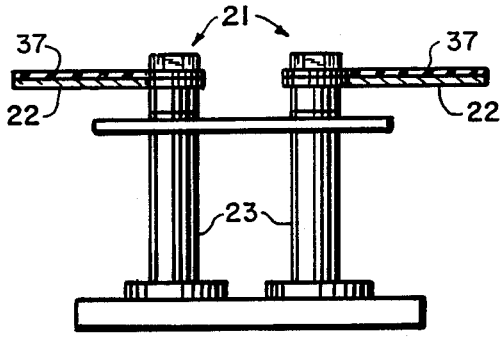
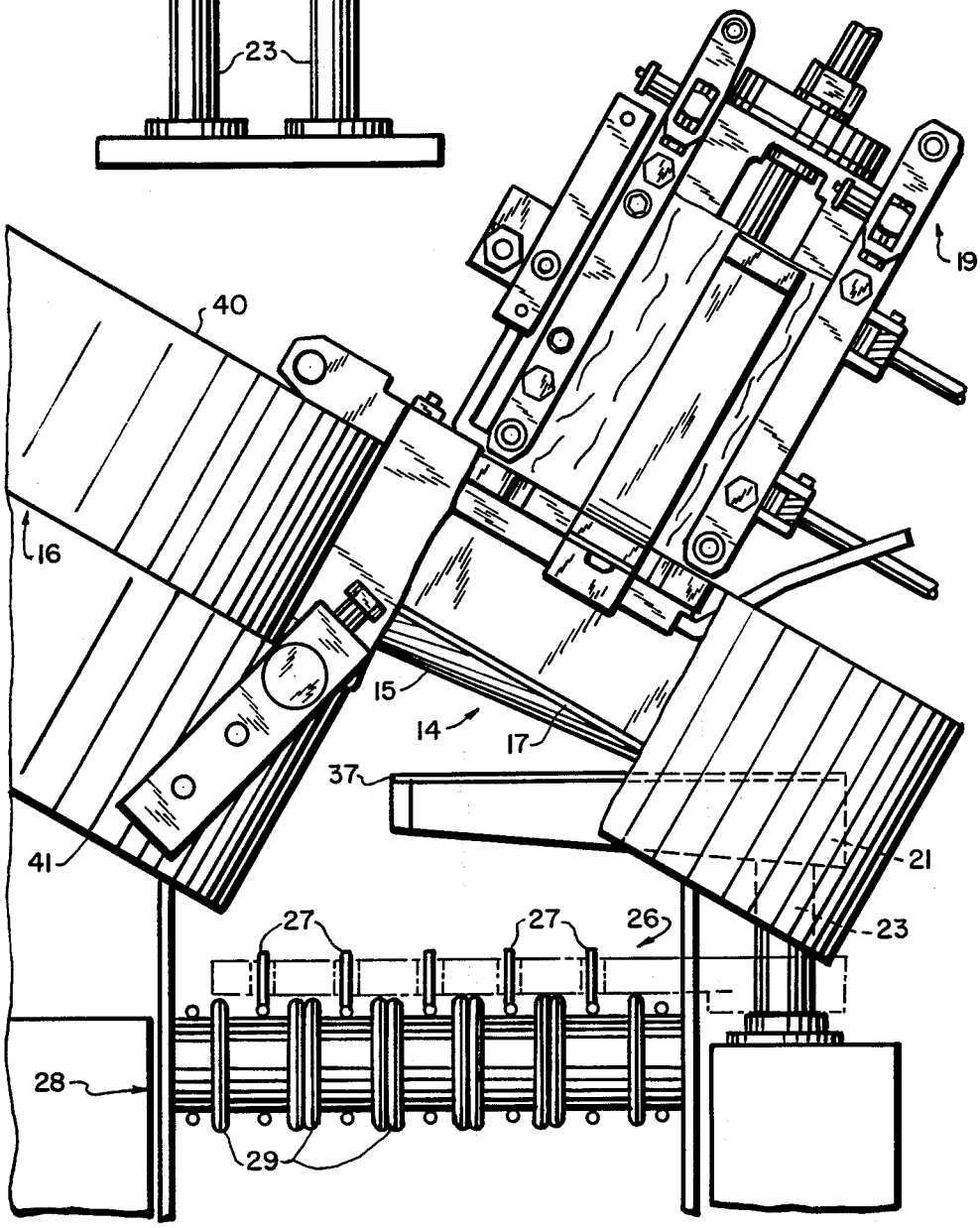
FIG. 4

FOOD LOAF SLICING MACHINE WITH IMPROVED STACKING CHARACTERISTICS

BACKGROUND OF THE INVENTION

. 1 Field of the Invention

The invention relates generally to high volume food loaf slicing machines. More specially, this invention relates to improvements of the food loaf slicing machine described and claimed in U.S. Pat. No. 4,428,263.

2. Description of the Prior Art

Many food loaf products, ranging from bologna and sausage through meat loaf, ham loaf, and other food loaf products, are initially manufactured in long loaves, usually ranging from two to six feet in length. These food loaves are then machine sliced and packaged prior to shipment to retail outlets. A food loaf slicing machine employed in this field should have a high rate of production, preferably in a range of at least two hundred to about seven hundred slices or more per minute. It is essential that the slices be cleanly and smoothly cut. To avoid undue waste, it is also important to maintain precise and accurate control of the weight of the individual slices as well as the weight of each stack. Continuous operation of the slicing machine is virtually essential, since any interuption required for removing errant slices, misformed stacks or for any other purpose materially reduces the production rate.

In one commercial food loaf slicing machine, each food loaf is fed generally downwardly, by a conveyor mechanism, into a slicing station. As the end of the loaf advances into the slicing station, it is cut off by a rotating orbiting circular knife. The orbiting motion of the knife, which swings the knife into and out of the slicing station, determines the slice rate or production rate of the machine. The rotation of the knife provides a clean slicing action. Machines of this general type, though basicially advantageous as compared with other slicing mechanisms, nevertheless present continuing difficult problems. Even the more advanced slicing machines that incorporate means for continuously adjusting the orbital knife rotation speeds present continuing high speed sliced product stacking problems.

SUMMARY OF THE INVENTION

It is an object of the present invention, therefore, to provide an improved high volume food loaf slicing machine utilizing an orbiting rotary knife in which the sliced food loaf is precisely and uniformly stacked as it is sliced.

A particular object of the invention is to provide an improved high volume food loaf slicing machine of the kind in which a food loaf is sliced by an orbiting rotating knife and the slices are stacked as they exit a slicing station, in which an energy absorption means is integrated into the stacking grids and the air turbulence generated by the rotating knife is reduced in the area of sliced product stacking.

Accordingly, in one aspect the invention relates to a high volume food loaf slicing machine of the kind comprising: a loaf support, supporting a food loaf for movement along a downwardly inclined path; loaf feed conveyor means, positioned at the lower end of the food loaf path, for continuously advancing a food loaf along that path and into a slicing station; a rotary knife, supported for orbital movement into and out of the slicing station in a direction transverse to the food loaf path, for cyclically cutting individual slices from the loaf as the loaf enters the slicing station, and contained within an upper and lower blade housing; variable speed main drive motor means; knife orbit drive connection means, connecting the main drive motor means to the knife to drive the knife through its orbital movement at a slicing rate determined by the speed of the main drive motor means; conveyor drive connection means, connecting the main drive motor means to the loaf feed conveyor means to drive the conveyor means at a loaf feed rate determined in part by the speed of the main drive motor means; variable speed knife rotation motor means, connected to the knife to drive the knife through its rotary motion at a cutting rate determined by the speed of the knife rotation motor means and independent of the speed of the main drive motor means and a sliced food stacker comprising two pair of stacker grids mounted on vertically movable rotatable support shafts, said stacker located immediately below the slicing station. The improvement comprising: a large air baffle forming a substantially continuous wall adjacent to the open area of the lower blade housing, said lower housing bounding said large baffle on its ends and bottom, said large baffle bounded on its top by the rotating knife blade as it rotates over it; a small air baffle mounted on the lower blade housing perpendicular to the plane of the knife blade and radially from the rotary knife orbiter, said small baffle bounded on its bottom and one end by the lower blade housing and on its other end by the rotating blade orbiter and on top by the rotating blade; and a vent port formed in the lower blade housing adjacent to the small baffle, wherein said port is sufficiently sized and shaped to allow turbulent air generated by the rotating knife blade to flow down and out of the blade housing rather than over the product to be sliced.

These and other objects, features and advantages of this invention will be clearly understood through a consideration of the following detailed description.

BRIEF DESCRIPTION OF THE DRAWINGS

In the course of this description, reference will be made to the attached drawings, wherein:

FIG. 4 is a side persepective view of the slicing station and sliced food stacker of the slicing machine of FIGS. 2 and 3 showing a further preferred embodiment of the present invention;

FIG. 5 is a side perspective view of the stacker grids see FIG. 4 and showing a preferred embodiment of the present invention.

DETAILED DESCRIPTION OF THE INVENTION

Figure 1:
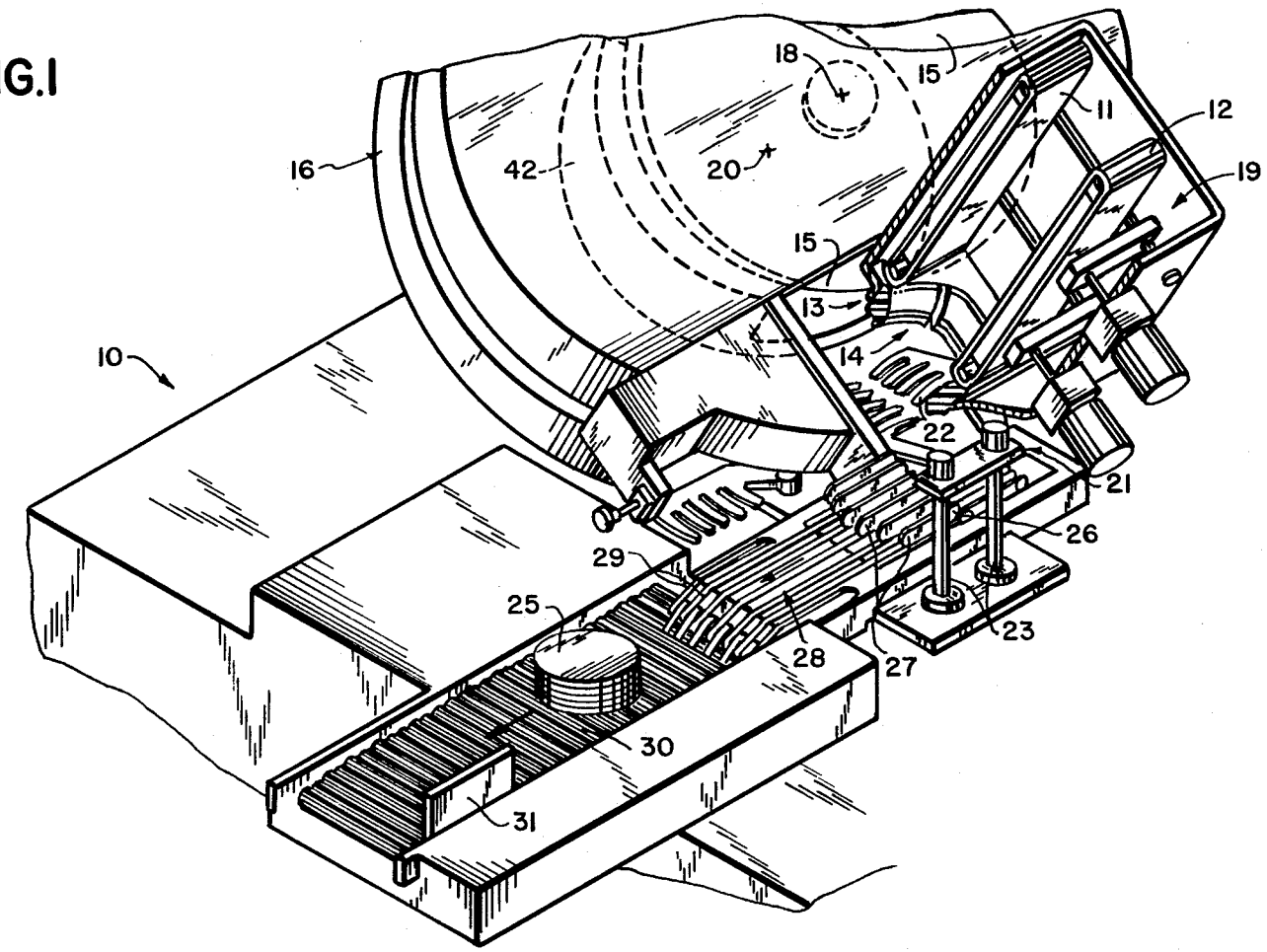
FIG. 1 is a perspective view of major components of a high volume food loaf slicing machine to which the present invention is directed, with some parts cut away to reveal others.

FIG. 1 illustrates the major components of a high volume food loaf slicing machine 10 to which the present invention is directed. The food loaf slicing machine 10 comprises further components that are not illustrated as they are not pertinent to the invention.

A food loaf is supported as it moves along a downwardly incline path that terminates at the entrance of a slicing station 14. The lower end of the loaf is engaged by two belt conveyors 11 and 12 incorporated in a loaf feed mechanism 19. The lower end of the food path terminates at a collar 13 which defines the entrance to the slicing station 14.

Figure 2:
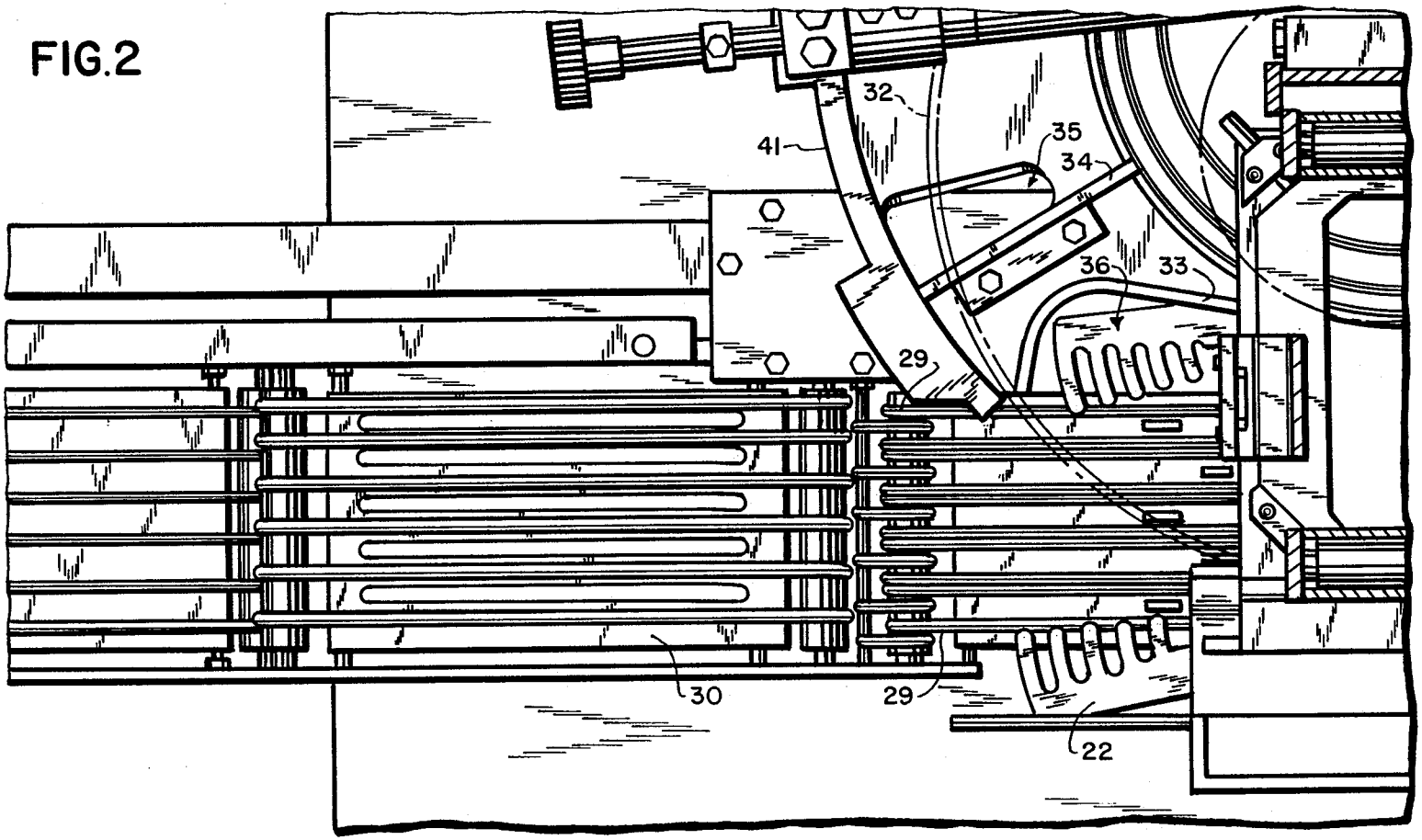
FIG. 2 is a more narrow perspective view of major components to the slicing machine of FIG. 1 showing a preferred embodiment of the present invention.
Figure 3:
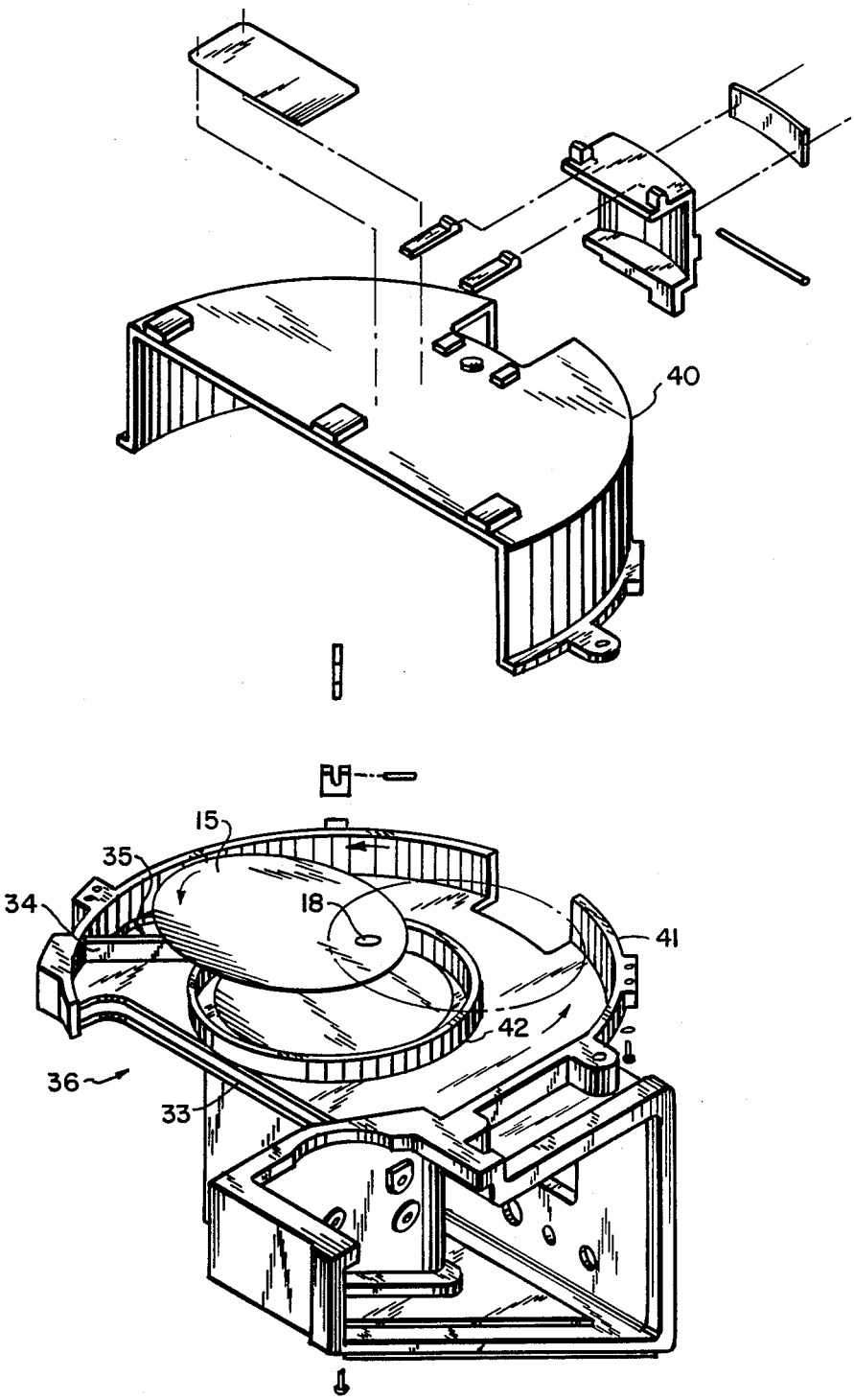
FIG. 3 is a partial exploded view of the rotary knife housing of FIG. 2 showing a preferred embodiment of the present invention.

A disk shaped rotary knife 15 is incorporated in slicing machine 10 and a knife head or knife housing 16 mounted on a drive assembly (not shown) in turn mounted on the top of a machine base. Knife housing 16 comprises an upper housing or first panel 40 (FIG. 3) and a lower housing or second panel 41 (FIGS. 2 and 3). Knife 15 is of slightly concave configuration with the concavity facing upwardly. Knife 15 is driven to perform two movements. The knife rotates about a first axis 18 and also orbits about a second axis 20. The orbital motion of axis 20 moves knife 15 cylindrically into an outer slicing station 14. The cylindrical rate of orbital motion of knife 15 is the slicing rate of machine 10. In FIG. 4, knife 15 is shown at the completion of a slicing operation and is beginning to move out of the slicing station 14.

A food loaf slice stacker 21 is incorporated in slicing machine 10, immediately below slicing station 14. Stacker 21 comprises two pair of stacker grids 22 mounted on vertically movable, rotatable support shafts 23; grids 22 are better shown in FIGS. 1, 2 and 5. Stacker grids 22 catch each food loaf slice as cut in slicing station 14. FIG. 1, accumulating a stack 25 containing a predetermined number of slices and depositing that stack on a weight scale 26, positioned immediately below the stacker. The only portion of scale 26 shown in the drawings comprises the upwardly extending vanes 27 on which each stack 25 is deposited for weighing. The operating mechanisms for scale 26 and stacker 21 are incorporated in the base of the slicing machine 10. A scale conveyor 28 is incorporated in slicing machine 10. As best shown in FIGS. 1 and 2, conveyor 28 comprises a plurality of flexible bands or O-rings 29 that extend between vanes 27 of scale 26.

As thus far described, apart from the stacker and scale mechanism, slicing machine 10 is generally conventional in construction. A large bologna, sausage, meat loaf, ham loaf or other food loaf is placed in the support located above the loaf feed mechanism 19. Usually the ends of the loaf are trimmed before the loaf is loaded into machine 10. The lower end of the loaf is engaged by the two loaf conveyors 11 and 12 of loaf feed mechanism 19 and is moved downwardly by those conveyors until the lower end of the loaf moving along the path erters collar 13. As the end of the loaf emerges from collar 13 into slicing station 14, knife 15 slices individual slices of predetermined thickness from the end of the loaf. Loaf movement is continuous. The thickness of each slice is determined by the feed rate at which loaf is advanced into the slicing station 14. As previously noted, the slicing rate is the orbiting rate of knife 15.

When slicing machine 10 is first placed in operation, one pair of stacker grids 22 is positioned in the raised closed position shown in FIG. 1. After a pre-selected number of slices are accumulated on this pair of stacker grids, the grids are lowered by shafts 23 to deposit the stacks 25 on vanes 27 of scale 26. The tines of the grids fit between the vanes. During this operation a second pair of stacker grids 22 is moved into position immediately below slicing station 14 to receive succeeding slices cut from the loaf and form a new stack.

As each stack of slices 25 is deposited on scale 26, it is weighed. The scale provides an output signal indicative of whether the stack is within pre-selected weight limits or outside of those limits. The correct weight stacks are discharged by scale conveyor 28 onto conveyor 30 and continue their movement directly outwardly of the machine along a takeaway conveyor (not shown). The off weight stacks are diverted by diverter 31 onto an off weight stack conveyor (not shown).

FIG. 3 taken in conjunction with FIG. 2 illustrates many of the principle features of the present invention as incorporated in slicing machine 10. The rotary knife 15 is mounted on a rotational drive shaft (not shown). The center line of this shaft is the rotational axis 18. The end of the rotational drive shaft opposite knife 15 is journalled in a bearing (not shown) mounted in orbit head 42, so that the cutting edge 17 (FIG. 4) of knife 15 describes an orbital path 32 (FIGS. 2 and 3). A main drive motor (not shown) has an output shaft (not shown) appropriately drive connected to a hollow shaft (also not shown) on which an orbit head 42 is mounted. The center line of the hollow shaft is the orbital axis 20.

When the slicing machine 10 is in operation the rotational movements of the orbiter 42 and knife 15 produce turbulent air that, due to the enclosing blade housing 16, exits through the open area 36 and the slicing station 14. The blade housing comprises a first and second panel or an upper 40 and lower 41 housing (both terms are used to refer to a two piece housing). The path of the exiting turbulent air intersects the sliced product as it is stacking on the stacker grids 22. The turbulent air increases as the slicing speed of the machine is increased. The velocity of the turbulent air generated by the rotating blade 15 and orbiter 42 reaches a point where the sliced product will no longer stack uniformly or properly. The capacity of the machine, therefore, is limited by its ability to properly stack and align the sliced product and not by its ability to feed and slice the food loaves. The exact deficiency or cause has not previously been known.

It has been found that the stacking capacity of the slicing machine can be greatly increased, 60 percent or more, by diverting and dampening the excessive energy encountered in the vacinity of the stacker grids 22. The most important aspect of the present invention is the installation and use of air baffles 33 and 34 (FIGS. 2 and 3) and a newly designed vent port 35. The second is an energy absorption means 37 integrated directly into the stacker grids 22. The first or large baffle 33 forms a wall across the open area 36 of the lower blade housing 41 and is bounded on the bottom and ends by the lower blade housing 41, and on the top by the blade 15 passing over it. The second or small baffle 34 is also located in the lower blade housing 41. It is bounded on the bottom and at one end by the lower blade housing 41 and the other end by the orbiter 42. The top is bounded by the rotating knife blade 15 as it passes over it. The second or small baffle 34 is preferably positioned perpendicular to the plane of the blade 15 and on a line extending radially from the center axis 20 of the orbiter shaft. If any of the baffles 33 and 34 are to be installed on the housing, as opposed to being cast into the housing itself, care should be taken to ensure sanitation requirements.

The baffles 33 and 34, in one embodiment, are mounted onto the lower blade housing 41. Such an embodiment is visualized as a modification to an existing piece of equipment as well as an improvement on newly manufactured models. The invention is the solution to a previously unsolvable problem. The location of the baffles 33 and 34 is important, not how they get there or of what they are made. The large baffle 33 blocks air exiting the slicer 10 (at open area 36) in the vacinity of slicing station 14. The small baffle 34 redirects the air thru the exit or vent port 35. The vent port 35 is most efficient when placed adjacent to the small baffle 34, although other locations wi11 also work. The vent port 35 should be sufficient when combined with the baffles 33 and 34, to significantly reduce the turbulent air exiting the slicer 10 in the vicinity of the stacking slices and the stacker grids 22. One embodiment has the vent port 35 approximately 5 inches long by 2 inches wide at the end outer most on the lower blade housing 41 and about 1 inch on the end towards the oroiter 42. Again the size and shape will depend on factors obvious to those skilled in the art.

The energy absorption means 37 is a modification that allows for more efficient energy absorption of the slices landing on the stacker grids 22. The slices, therefore, settle on the stack more smoothly with less slice distortion resulting in a more even, better aligned stack. One embodiment of the energy absorption means 37, as shown in FIG. 5, is the application of a rubber surface vulcanized to the upper surface of the stacker grids 22 and trimmed to conform to the existing shape of the grids 22.

What is claimed is:

1. In a high volume food loaf slicing machine of the kind comprising: a loaf support, supporting a food loaf for movement along a downwardly inclined path;

loaf feed conveyor means, positioned at the lower end of the food loaf path, for continuously advancing a food loaf along that path and into a slicing station;

a rotary knife, supported for orbital movement into and out of the slicing station in a direction transverse to the food loaf path, for cyclically cutting individual slices from the loaf as the loaf enters the slicing station, and contained within a blade housing wherein said blade housing comprises upper and lower blade housings;

variable speed main drive motor means;

knife orbit drive connection means, connecting the main drive motor means to the knife to drive the knife through its orbital movement at a slicing rate determined by the speed of the main drive motor means;

conveyor drive connection means, connecting the main drive motor means to the loaf feed conveyor means to drive the conveyor means at a loaf feed rate determined in part by the speed of the main drive motor means;

variable speed knife rotation motor means, connected to the knife to drive the knife through its rotary motion at a cutting rate determined by the speed of the knife rotation motor means and independent of the speed of the main drive motor means;

and a sliced food stacker comprising two pair of stacker grids mounted on vertically movable rotatable support shafts, said stacker located immediately below the slicing station.

the improvement comprising;

a large air baffle forming a substantially continuous wall adjacent to the open area of the lower blade housing, said lower housing bounding said large baffle on its ends and bottom, said large baffle bounded on its top by the rotating knife blade as it rotates over it;

a small air baffle mounted on the lower blade housing perpendicular to the plane of the knife blade and radially from the rotary knife orbiter, said small baffle bounded on its bottom and one end by the lower blade housing and on its other end by the rotating blade orbiter and on top by the rotating blade;

and a vent port formed in the lower blade housing wherein said port is sufficiently sized and shaped to allow turbulent air generated by the rotating knife blade to flow down and out of the blade housing rather than over the product to be sliced.

2. An improved high volume food loaf slicing machine as claimed in claim 1 wherein said improvement further comprises a sliced food energy absorption means attached to the stacker grids.

3. An improved high volume food loaf slicing machine as claimed in claim 2 wherein said energy absorption means comprises rubber vulcanized to the sliced product receiving surfaces of the stacker grids.

4. An improved high volume food loaf slicing machine as claimed in claim 1 wherein the vent port is about 5 inches in length and about 2 inches wide at the end furthest from the orbiter and about 1 inch wide at the end closest to the orbiter.

5. An improved high volume food loaf slicing machine as claimed in claim 4 wherein the improvement further comprises rubber vulcanized to the sliced product receiving surfaces of the stacker grids.

6. In a high volume food loaf slicing machine of the kind comprising: a loaf support, supporting a food loaf for movement along a downwardly inclined path;

loaf feed conveyor means, positioned at the lower end of the food loaf path, for continuously advancing a food loaf along that path and into a slicing station;

a rotary knife, supported for orbital movement into and out of a slicing station in a direction transverse to the food loaf path, for cyclically cutting individual slices from the loaf as the loaf enters the slicing station, and contained within a blade housing;

a blade housing for containing said rotary knife said blade housing comprising upper and lower housing components;

variable speed main drive motor means;

knife orbit drive connection means, connecting the main drive motor means to the knife to drive the knife through its orbital movement at a slicing rate determined by the speed of the main drive motor means;

conveyor drive connection means, connecting the main drive motor means to the loaf feed conveyor means to drive the conveyor means at a loaf feed rate determined in part by the speed of the main drive motor means;

variable speed knife rotation motor means, connected to the knife to drive the knife through its rotary motion at a cutting rate determined by the speed of the knife rotation motor means and independent of the speed of the main drive motor means;

and a sliced food stacker comprising two pair of stacker grids mounted on vertically movable rotatable support shafts, said stacker located immediately below the slicing station.

the improvement comprising;

a large air baffle forming a substantially continuous wall adjacent to the open area of the lower blade housing, said lower housing bounding said large baffle on its ends and bottom, said large baffle bounded on its top by the rotating knife blade as it rotates over it;

a small air baffle mounted on the lower blade housing perpendicular to the plane of the knife blade and radially from the rotary knife orbiter, said small baffle bounded on its bottom and one end by the lower blade housing and on its other end by the rotating blade orbiter and on top by the rotating blade;

and a vent port formed in the lower blade housing adjacent to the small baffle, wherein said port is sufficiently sized and shaped to allow turbulent air generated by the rotating knife blade to flow down and out of the blade housing rather than over the product to be sliced.

7. An improved high volume food loaf slicing machine as claimed in claim 6 wherein the vent port is about 5 inches in length and about 2 inches wide at the end furthest from the orbiter and about 1 inch wide at the end closest to the orbiter.

8. An improved high volume food loaf slicing machine as claimed in claim 1 wherein said small baffle is positioned perpendicular to the plane of the knife blade and extending radially from the center axis of the orbiter.

9. An improved high volume food loaf slicing machine as claimed in claim 6 wherein said small baffle is positioned perpendicular to the plane of the knife blade and extending radially from the center axis of the orbiter.

10. A food loaf slicing machine comprising:

a loaf feed conveyor means for advancing a food loaf along a path and into a slicing station;

a rotary knife, supported for orbital movement into and out of the slicing station in a direction transverse to the food loaf path for cutting individual slices from the loaf as the loaf enters the slicing station;

knife rotation motor means connected to the rotary knife to drive the rotary knife through its rotary motion;

a blade housing for containing the rotating knife, said blade housing having a first and second panel, substantially parallel and connected by a wall and having an opening in the vicinity of the slicing station and wherein the orbital path of the rotary knife is closer to the first panel than the second panel;

a first air baffle affixed to the second panel and forming a substantially continuous wall adjacent to the open area of the blade housing, said first baffle substantially bounded by the rotating knife blade as it rotates over it;

a second air baffle mounted on the second panel substantially perpendicular to the plane of the knife blade, radially from the rotary knife orbiter and to the interior of the blade housing such that the orbiting rotating blade passes over said second baffle prior to passing over said first baffle;

a vent port formed in the second panel wherein said port is sufficiently sized and shaped to allow turbulent air generated by the rotating knife blade out of the blade housing rather than over the product to be sliced.

main drive motor means;

knife orbit drive connection means, connecting the main drive motor means to the knife to drive the knife through its orbital movement;

conveyor drive connection means connecting the main drive motor means to the loaf feed conveyor means; and a sliced food stacker comprising stacker grids mounted on movable support shafts, said stacker located immediately below the slicing station.

11. A food loaf slicing machine as claimed in claim 10 wherein said vent port is adjacent to said second air baffle.

* * * * *